US011661642B2

(12) United States Patent
Endo et al.

(10) Patent No.: US 11,661,642 B2
(45) **Date of Patent: *May 30, 2023**

(54) HIGH-STRENGTH STEEL SHEET AND METHOD FOR MANUFACTURING SAME

(71) Applicant: JFE STEEL CORPORATION, Tokyo (JP)

(72) Inventors: Kazuki Endo, Tokyo (JP); Yoshiyasu Kawasaki, Tokyo (JP); Yuki Toji, Tokyo (JP); Yoshimasa Funakawa, Tokyo (JP); Mai Aoyama, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 48 days.

This patent is subject to a terminal disclaimer.

(21) Appl. No.: 17/042,250

(22) PCT Filed: Mar. 20, 2019

(86) PCT No.: PCT/JP2019/011645

§ 371 (c)(1),
(2) Date: Sep. 28, 2020

(87) PCT Pub. No.: WO2019/188640

PCT Pub. Date: Oct. 3, 2019

(65) Prior Publication Data

US 2021/0115541 A1 Apr. 22, 2021

(30) Foreign Application Priority Data

Mar. 30, 2018 (JP) ..... JP2018-066715

(51) Int. Cl.

| | |
|---|---|
| ***C22C 38/04*** | (2006.01) |
| ***B21B 27/10*** | (2006.01) |
| ***C21D 6/00*** | (2006.01) |
| ***C21D 8/02*** | (2006.01) |
| ***C22C 33/02*** | (2006.01) |

(52) U.S. Cl.

CPC ..... *C22C 38/04* (2013.01); *B21B 27/106* (2013.01); *C21D 6/005* (2013.01); *C21D 8/0226* (2013.01); *C22C 33/0264* (2013.01)

(58) Field of Classification Search

CPC ..... B21B 27/106; C21D 2211/001; C21D 2211/005; C21D 2211/008; C21D 6/005; C21D 8/0263; C21D 8/0268; C21D 8/0278; C21D 9/46; C22C 33/0264; C22C 38/04; C22C 2/02

USPC ..... 148/337

See application file for complete search history.

(56) References Cited

U.S. PATENT DOCUMENTS

| | | | | |
|---|---|---|---|---|
| 2007/0095444 | A1 | 5/2007 | Nonaka et al. | |
| 2010/0218857 | A1 | 9/2010 | Nakagaito et al. | |
| 2012/0222781 | A1 | 9/2012 | Azuma et al. | |
| 2014/0230971 | A1 | 8/2014 | Kawasaki et al. | |
| 2014/0360632 | A1 | 12/2014 | Hasegawa et al. | |
| 2014/0377582 | A1 | 12/2014 | Azuma et al. | |
| 2015/0004433 | A1 | 1/2015 | Tanaka et al. | |
| 2015/0037610 | A1* | 2/2015 | Hata | C21D 9/46 148/333 |
| 2015/0167133 | A1 | 6/2015 | Paul et al. | |
| 2017/0175219 | A1 | 6/2017 | Kawasaki et al. | |
| 2017/0204490 | A1 | 7/2017 | Kawasaki et al. | |
| 2017/0211163 | A1 | 7/2017 | Kawasaki et al. | |
| 2017/0218472 | A1 | 8/2017 | Kawasaki et al. | |
| 2017/0298482 | A1 | 10/2017 | Kawasaki et al. | |
| 2017/0306435 | A1* | 10/2017 | Kawasaki | C22C 38/60 |
| 2017/0314091 | A1 | 11/2017 | Kawasaki et al. | |
| 2017/0327919 | A1 | 11/2017 | Kawasaki et al. | |
| 2018/0057916 | A1 | 3/2018 | Obata et al. | |
| 2018/0127846 | A9 | 5/2018 | Kawasaki et al. | |
| 2018/0127847 | A9 | 5/2018 | Kawasaki et al. | |
| 2021/0010101 | A1* | 1/2021 | Endo | C21D 8/0226 |
| 2021/0115541 | A1 | 4/2021 | Endo et al. | |

FOREIGN PATENT DOCUMENTS

| | | | |
|---|---|---|---|
| CN | 1788099 | A | 6/2006 |
| CN | 1888117 | A | 1/2007 |
| CN | 101595235 | A | 12/2009 |
| CN | 101821419 | A | 9/2010 |
| CN | 102639739 | A | 8/2012 |

(Continued)

OTHER PUBLICATIONS

Nov. 25, 2020 Extended European Search Report issued in European Patent Application No. 19777630.5.
Jan. 26, 2022 Office Action issued in Korean Patent Application No. 10-2020-7027846.
May 18, 2021 Office Action and Search Report issued in Chinese Patent Application No. 201980023569.0.
Jun. 25, 2019 International Search Report issued in International Patent Application No. PCT/JP2019/011645.
Jun. 25, 2019 International Search Report issued in International Patent Application No. PCT/JP2019/011648.
Nov. 20, 2020 Search Report issued in European Patent Application No. 19778161.0.
May 28, 2021 Office Action issued in Chinese Patent Application No. 201980023783.6.

(Continued)

*Primary Examiner* — Jie Yang
(74) *Attorney, Agent, or Firm* — Oliff PLC

(57) ABSTRACT

A high-strength steel sheet includes a steel structure with: ferrite being 35% to 80%, martensite being 5% to 35%, and tempered martensite being 0% to 5% in terms of area fraction; retained austenite being 8% or more in terms of volume fraction; an average grain size of: the ferrite being 6 μm or less; and the retained austenite being 3 μm or less; a value obtained by dividing an area fraction of blocky austenite by a sum of area fractions of lath-like austenite and the blocky austenite being 0.6 or more; a value obtained by dividing, by mass %, an average Mn content in the retained austenite by an average Mn content in the ferrite being 1.5 or more; and a value obtained by dividing, by mass %, an average C content in the retained austenite by an average C content in the ferrite being 3.0 or more.

5 Claims, No Drawings

(56) References Cited

FOREIGN PATENT DOCUMENTS

| | | | |
|---|---|---|---|
| CN | 103797145 | A | 5/2014 |
| CN | 104105807 | A | 10/2014 |
| CN | 104114731 | A | 10/2014 |
| CN | 104245971 | A | 12/2014 |
| CN | 106574340 | A | 4/2017 |
| CN | 106574341 | A | 4/2017 |
| CN | 107075627 | A | 8/2017 |
| CN | 107075643 | A | 8/2017 |
| CN | 107075644 | A | 8/2017 |
| CN | 107148486 | A | 9/2017 |
| CN | 107250409 | A | 10/2017 |
| EP | 1096029 | A1 | 5/2001 |
| EP | 1264911 | A2 | 12/2002 |
| EP | 1 365 037 | A1 | 11/2003 |
| EP | 2 559 782 | A1 | 2/2013 |
| EP | 2 757 169 | A1 | 7/2014 |
| EP | 3050988 | A1 | 8/2016 |
| EP | 3 114 199 | A1 | 1/2017 |
| EP | 3 178 957 | A1 | 6/2017 |
| EP | 3 279 363 | A1 | 2/2018 |
| EP | 3 382 049 | A1 | 10/2018 |
| JP | S61-157625 | A | 7/1986 |
| JP | H01-259120 | A | 10/1989 |
| JP | 2001-207235 | A | 7/2001 |
| JP | 2003-138345 | A | 5/2003 |
| JP | 2011-168816 | A | 9/2011 |
| JP | 6179677 | B2 | 8/2017 |
| KR | 10-2014-0075789 | A | 6/2014 |
| KR | 10-2017-0067850 | A | 6/2017 |
| WO | 2008/093815 | A1 | 8/2008 |
| WO | 2009/054539 | A1 | 4/2009 |
| WO | 2013/146148 | A1 | 10/2013 |
| WO | 2015/134163 | A1 | 9/2015 |
| WO | 2016/021197 | A1 | 2/2016 |
| WO | 2016/067623 | A1 | 5/2016 |
| WO | 2016/132680 | A1 | 8/2016 |

OTHER PUBLICATIONS

Jan. 27, 2022 Office Action issued in Korean Patent Application No. 10-2020-7027848.

U.S. Appl. No. 17/042,291, filed Sep. 28, 2020 in the name of Endo et al.

Dec. 9, 2022 Office Action issued in U.S. Appl. No. 17/042,291.

Nov. 24, 2022 Office Action issued in Korean Patent Application No. 2020-7027846.

Mar. 21, 2023 Office Action issued in U.S. Appl. No. 17/042,291.

Mar. 22, 2023 Office Action issued in Korean Patent Application No. 10-2020-7027846.

* cited by examiner

HIGH-STRENGTH STEEL SHEET AND METHOD FOR MANUFACTURING SAME

FIELD

The present invention relates to a high-strength steel sheet suitably used for members used in industrial fields such as automobile and electric ones and excellent in formability and a method for manufacturing same and, in particular, relates to a high-strength steel sheet having a tensile strength (TS) of 980 MPa or more and being excellent not only in ductility but also in hole expandability and a method for manufacturing same.

BACKGROUND

In recent years, from the viewpoint of conservation of the global environment, improvement in fuel efficiency of automobiles has been an important issue. Thus, increasingly, actions are taken to thin vehicle body materials by increasing the strength of the vehicle body materials and to reduce the weight of vehicle bodies. However, increasing the strength of a steel sheet, which is one of the vehicle body materials, brings about a reduction in the formability of the steel sheet, and thus there is a need to develop a steel sheet having both high strength and high ductility. As the steel sheet with high strength and high ductility, a high-strength steel sheet using deformation-induced transformation of retained austenite has been developed. This high-strength steel sheet, showing a structure having the retained austenite, is easily formed by the retained austenite during forming and is provided with high strength because of the martensitic transformation from the retained austenite after forming.

Patent Literature 1 describes a high-strength steel sheet having extremely high ductility using the deformation-induced transformation of the retained austenite with a tensile strength of 1,000 MPa or more and a total elongation (EL) of 30% or more, for example. Patent Literature 2 describes an invention achieving a high strength-ductility balance by performing a ferrite-austenite intercritical annealing using a high Mn steel.

Patent Literature 3 describes an invention improving local elongation by forming a microstructure containing bainite or martensite after hot rolling in a high Mn steel, forming fine retained austenite by annealing and tempering, and, in addition, forming a microstructure containing tempered bainite or tempered martensite. In addition, Patent Literature 4 describes an invention forming stable retained austenite to improve total elongation by performing a ferrite-austenite intercritical annealing to concentrate Mn into untransformed austenite using a medium Mn steel.

CITATION LIST

Patent Literature

Patent Literature 1: Japanese Patent Application Laid-open No. S61-157625

Patent Literature 2: Japanese Patent Application Laid-open No. H01-259120

Patent Literature 3: Japanese Patent Application Laid-open No. 2003-138345

Patent Literature 4: Japanese Patent No. 6179677

SUMMARY

Technical Problem

The high-strength steel sheet described in Patent Literature 1 is manufactured by performing what is called austemper treatment, which austenitizes a steel sheet with C, Si, and Mn as basic components, then quenches it within a bainite transformation temperature range, and isothermally maintains it. The retained austenite is formed by enrichment of C into the austenite by this austemper treatment, in which a large amount of C addition greater than 0.3% is required in order to obtain a large amount of the retained austenite. However, when a C content in steel is higher, spot weldability reduces; in a C content greater than 0.3% in particular, the reduction is conspicuous. Thus, it is difficult to put the high-strength steel sheet described in Patent Literature 1 to practical use as an automobile steel sheet. In addition, the invention described in Patent Literature 1 mainly aims at improving the ductility of the high-strength steel sheet and does not take hole expandability and bendability into account.

In the invention described in Patent Literature 2, improvement in ductility by Mn enrichment into untransformed austenite is not studied, and there is room for improvement in formability. In the invention described in Patent Literature 3, the high Mn steel is a structure containing a large amount of bainite or martensite tempered at a high temperature, and thus it is difficult to ensure strength. In addition, the amount of the retained austenite is limited in order to improve local elongation, and total elongation is insufficient. In the invention described in Patent Literature 4, the heat treatment time is short, the diffusion of Mn is slow, and thus it is inferred that enrichment of Mn into austenite is insufficient.

The present invention has been made in view of the above problems, and an object thereof is to provide a high-strength steel sheet having a tensile strength (TS) of 980 MPa or more and having excellent formability and a method for manufacturing the same. In the present specification, the formability means ductility and hole expandability.

Solution to Problem

To solve the above problems and to manufacture a high-strength steel sheet having excellent formability, the inventors of the present invention have conducted earnest studies from the viewpoints of a component composition of a steel sheet and a method of manufacture to find out the following. Specifically, it has been found out that a high-strength steel sheet excellent in formability such as ductility and hole expandability through the ensuring of the retained austenite stabilized with Mn can be manufactured in which 3.10% by mass or more and 4.20% by mass or less of Mn is contained, a component composition of other alloy elements such as Ti is appropriately adjusted, and a steel slab is subjected to hot rolling, then holding for more than 21,600 s within a temperature range of an $Ac_1$ transformation temperature or more and the $Ac_1$ transformation temperature+150° C. or less, cold rolling, then holding for 20 s or more and 900 s or less within a temperature range of the $Ac_1$ transformation temperature or more, then cooling, then pickling treatment, holding for 20 s or more and 900 s or less within a temperature range of the $Ac_1$ transformation temperature or more and the $Ac_1$ transformation temperature+150° C. or less, and then cooling to bring about ferrite being 35% or more and 80% or less, martensite being 5% or more and 35% or less, and tempered martensite being 0% or more and 5% or less in terms of area fraction and retained austenite being 8% or more in terms of volume fraction, in addition, an average grain size of the ferrite being 6 μm or less, an average grain size of the retained austenite being 3 μm or less, and a value obtained by dividing an area fraction of blocky austenite by a sum of area fractions of lath-like austenite and the blocky austenite being 0.6 or more, a value obtained by dividing an average Mn content (% by mass) in the retained austenite by an average Mn content (% by mass) in the ferrite being 1.5 or more, and a value obtained by dividing an average C content (% by mass) in the retained austenite by an average C content (% by mass) in the ferrite being 3.0 or more.

The present invention has been made based on the above-mentioned knowledge, and the gist thereof is as follows.

To solve the problem and achieve the object, a high-strength steel sheet according to the present invention includes: a component composition including: by mass %, C: 0.030% to 0.250%; Si: 0.01% to 3.00%; Mn: 3.10% to 4.20%; P: 0.001% to 0.100%; S: 0.0001% to 0.0200%; N: 0.0005% to 0.0100%; Al: 0.001% to 1.200%; and balance Fe and inevitable impurities; and a steel structure with: ferrite being 35% to 80%, martensite being 5% to 35%, and tempered martensite being 0% to 5% in terms of area fraction; retained austenite being 8% or more in terms of volume fraction; an average grain size of the ferrite being 6 μm or less; an average grain size of the retained austenite being 3 μm or less; a value obtained by dividing an area fraction of blocky austenite by a sum of area fractions of lath-like austenite and the blocky austenite being 0.6 or more; a value obtained by dividing an average Mn content, by mass %, in the retained austenite by an average Mn content, by mass %, in the ferrite being 1.5 or more; and a value obtained by dividing an average C content, by mass %, in the retained austenite by an average C content, by mass %, in the ferrite being 3.0 or more.

Moreover, in the high-strength steel sheet according to the present invention, the component composition of the high-strength steel sheet further includes: by mass %, at least one element selected from Ti: 0.005% to 0.200%; Nb: 0.005% to 0.200%; V: 0.005% to 0.500%; W: 0.005% to 0.500%; B: 0.0003% to 0.0050%; Ni: 0.005% to 1.000%, Cr: 0.005% to 1.000%, Mo: 0.005% to 1.000%, Cu: 0.005% to 1.000%, Sn: 0.002% to 0.200%, Sb: 0.002% to 0.200%, Ta: 0.001% to 0.100%, Ca: 0.0005% to 0.0050%, Mg: 0.0005% to 0.0050%, Zr: 0.0005% to 0.0050%, and REM: 0.0005% to 0.0050%; and balance Fe and inevitable impurities.

Moreover, a method of manufacturing a high-strength steel sheet according to the present invention is a method including: heating a steel slab having the component composition of the high-strength steel sheet according to the present invention; hot rolling the steel slab with a finishing delivery temperature in hot-rolling within a temperature range of 750° C. to 1,000° C., such that the steel slab becomes a hot rolled steel sheet; coiling up the hot rolled steel sheet within a temperature range of 300° C. to 750° C.; holding the hot rolled steel sheet for more than 21,600 s within a temperature range of an $Ac_1$ transformation temperature to the $Ac_1$ transformation temperature+150° C.; cold rolling the hot rolled steel sheet; holding the hot rolled steel sheet for 20 s to 900 s within a temperature range of the $Ac_1$ transformation temperature to the $Ac_1$ transformation temperature+150° C.; and cooling the hot rolled steel sheet.

Moreover, a method of manufacturing a high-strength steel sheet according to the present invention is a method including: heating a steel slab having the component composition of the high-strength steel sheet according to the present invention; hot rolling the steel slab with a finishing delivery temperature in hot rolling within a temperature range of 750° C. to 1,000° C., such that the steel slab becomes a hot rolled steel sheet; coiling up the hot rolled steel sheet within a temperature range of 300° C. to 750° C.; holding the hot rolled steel sheet for more than 21,600 s within a temperature range of an $Ac_1$ transformation temperature to the $Ac_1$ transformation temperature+150° C.; cold rolling the hot rolled steel sheet; holding the hot rolled steel sheet for 20 s to 900 s within a temperature range of the $Ac_1$ transformation temperature to the $Ac_1$ transformation temperature+150° C.; cooling the hot rolled steel sheet; and performing galvanization treatment on the hot rolled steel sheet.

Moreover, a method of manufacturing a high-strength steel sheet according to the present invention is a method including: heating a steel slab having the component composition of the high-strength steel sheet according to the present invention; hot rolling the steel slab with a finishing delivery temperature in hot rolling within a temperature range of 750° C. to 1,000° C., such that the steel slab becomes a hot rolled steel sheet; coiling up the hot rolled steel sheet within a temperature range of 300° C. to 750° C.; holding the hot rolled steel sheet for more than 21,600 s within a temperature range of an $Ac_1$ transformation temperature to the $Ac_1$ transformation temperature+150° C.; cold rolling the hot rolled steel sheet; holding the hot rolled steel sheet for 20 s to 900 s within a temperature range of the $Ac_1$ transformation temperature to the $Ac_1$ transformation temperature+150° C.; cooling the hot rolled steel sheet; performing galvanization treatment on the hot rolled steel sheet; and performing galvannealing treatment on the hot rolled steel sheet within a temperature range of 450° C. to 600° C.

Moreover, a method of manufacturing a high-strength steel sheet according to the present invention is a method including: heating a steel slab having the component composition of the high-strength steel sheet according to the present invention; hot rolling the steel slab with a finishing delivery temperature in hot rolling within a temperature range of 750° C. to 1,000° C., such that the steel slab becomes a hot rolled steel sheet; coiling up the hot rolled steel sheet within a temperature range of 300° C. to 750° C.; holding the hot rolled steel sheet for more than 21,600 s within a temperature range of an $Ac_1$ transformation temperature to the $Ac_1$ transformation temperature+150° C.; cold rolling the hot rolled steel sheet; holding the hot rolled steel sheet for 20 s to 900 s within a temperature range of the $Ac_1$ transformation temperature or more; cooling the hot rolled steel sheet; performing pickling treatment on the hot rolled steel sheet; holding the hot rolled steel sheet for 20 s to 900 s within a temperature range of the $Ac_1$ transformation temperature to the $Ac_1$ transformation temperature+150° C.; cooling the hot rolled steel sheet; and performing galvanization treatment the hot rolled steel sheet.

Moreover, a method of manufacturing a high-strength steel sheet according to the present invention is a method including: heating a steel slab having the component composition of the high-strength steel sheet according to the claimed invention; hot rolling the steel slab with a finishing delivery temperature in hot rolling within a temperature range of 750° C. to 1,000° C., such that the steel slab becomes a hot rolled steel sheet; coiling up the hot rolled steel sheet within a temperature range of 300° C. to 750° C.; holding the hot rolled steel sheet for more than 21,600 s within a temperature range of an $Ac_1$ transformation temperature to the $Ac_1$ transformation temperature+150° C.; cold rolling the hot rolled steel sheet; holding the hot rolled steel sheet for 20 s to 900 s within a temperature range of the $Ac_1$ transformation temperature or more; cooling the hot rolled steel sheet; performing pickling treatment on the hot rolled steel sheet; holding the hot rolled steel sheet for 20 s to 900 s within a temperature range of the $Ac_1$ transformation temperature to the $Ac_1$ transformation temperature+150° C.; cooling the hot rolled steel sheet; performing galvanization treatment on the hot rolled steel sheet; and performing galvannealing treatment on the hot rolled steel sheet within a temperature range of 450° C. to 600° C.

Advantageous Effects of Invention

The present invention can provide a high-strength steel sheet having a tensile strength (TS) of 980 MPa or more and having excellent formability and a method for manufacturing the same.

DESCRIPTION OF EMBODIMENTS

The following describes a high-strength steel sheet and a method for manufacturing the same according to the present invention.

(1) The following describes reasons why the steel component composition is limited to the above ranges in the high-strength steel sheet according to the present invention.

[C: 0.030% or More and 0.250% or Less]

C is an element required in order to form a low-temperature transformation phase such as martensite and to increase strength. In addition, C is an element effective in increasing the stability of retained austenite and improving the ductility of the steel. When the content of C is less than 0.030%, an area fraction of ferrite is excessive, and desired strength cannot be achieved. In addition, it is difficult to ensure a sufficient volume fraction of the retained austenite, and favorable ductility cannot be achieved. On the other hand, when C is excessively added over 0.250%, an area fraction of the martensite, which is hard, is excessive. In addition, during a hole expansion test, the number of microvoids in grain boundaries of the martensite increases, and, in addition, propagation of cracks proceeds, thus reducing hole expandability. In addition, welds and heat affected parts are markedly hardened, the mechanical characteristics of the welds reduce, and thus spot weldability and arc weldability degrade. From these viewpoints, the content of C is set within a range of 0.030% or more and 0.250% or less and preferably 0.080% or more and 0.200% or less.

[Si: 0.01% or More and 3.00% or Less]

Si is effective in ensuring favorable ductility in order to improve the work hardenability of the ferrite. When the content of Si is less than 0.01%, a Si addition effect is poor, and thus the lower limit of the content of Si is set to 0.01%. However, excessive Si addition with a content of greater than 3.00% causes embrittlement of the steel and degrades ductility and hole expandability (punching). In addition, degradation in surface properties by the occurrence of red scales and the like is caused, and chemical conversion treatability and coating quality are degraded. In addition, degradation in coating quality is brought about. Thus, the content of Si is within a range of 0.01% or more and 3.00% or less, preferably 0.20% or more and 2.00% or less, and more preferably 0.20% or more and less than 0.70%.

[Mn: 3.10% or More and 4.20% or Less]

Mn is an extremely important additive element in the present invention. Mn is an element stabilizing the retained austenite, is effective in ensuring favorable ductility, and, in addition, is an element increasing the strength of the steel through solid solution strengthening. Such actions are found when the content of Mn is 3.10% or more. However, excessive addition with a content of Mn greater than 4.20% degrades chemical conversion treatability and coating quality. From these viewpoints, the content of Mn is within a range of 3.10% or more and 4.20% or less, preferably 3.20% or more and less than 4.10%, and more preferably 3.20% or more and less than 3.80%.

[P: 0.001% or More and 0.100% or Less]

P is an element having an action of solid solution strengthening and can be added in accordance with desired strength. In addition, P is an element also effective in forming a dual phase structure in order to facilitate ferrite transformation. To obtain such effects, the content of P is required to be set to 0.001% or more. On the other hand, when the content of P is greater than 0.100%, degradation in weldability is brought about, and when hot-dip galvanization is subjected to galvannealing treatment, an alloying rate is reduced, and the quality of the hot-dip galvanization is impaired. Consequently, the content of P is set within a range of 0.001% or more and 0.100% or less and preferably 0.005% or more and 0.050% or less.

[S: 0.0001% or More and 0.0200% or Less]

S segregates in grain boundaries to embrittle the steel during hot working and is present as sulfides to reduce local deformability. Thus, the upper limit of the content of S is required to be set to 0.0200% or less, preferably 0.0100% or less, and more preferably 0.0050% or less. However, due to production technical restrictions, the content of S is required to be set to 0.0001% or more. Consequently, the content of S is set within a range of 0.0001% or more and 0.0200% or less, preferably 0.0001% or more and 0.0100% or less, and more preferably 0.0001% or more and 0.0050% or less.

[N: 0.0005% or More and 0.0100% or Less]

N is an element degrading the aging resistance of the steel. When the content of N is greater than 0.0100% in particular, degradation in the aging resistance is conspicuous. Although the content of N is preferably smaller, the content of N is required to be set to 0.0005% or more due to production technical restrictions. Consequently, the content of N is set within a range of 0.0005% or more and 0.0100% or less and preferably 0.0010% or more and 0.0070% or less.

[Al: 0.001% or More and 1.200% or Less]

Al is an element effective in expanding a ferrite-austenite two-phase region and a reduction in annealing temperature dependency, that is, material quality stability. In addition, Al is an element acting as a deoxidizer and effective in the cleanliness of the steel and is preferably added in a deoxidization process. When the content of Al is less than 0.001%, its addition effect is poor, and thus the lower limit of the content of Al is set to 0.001%. However, a large amount addition with a content of greater than 1.200% increases the risk of the occurrence of steel slab cracks during continuous casting and reduces manufacturability. From these viewpoints, the content of Al is set within a range of 0.001% or more and 1.200% or less, preferably 0.020% or more and 1.000% or less, and more preferably 0.030% or more and 0.800% or less.

In addition to the above components, at least one element selected from Ti: 0.005% or more and 0.200% or less, Nb: 0.005% or more and 0.200% or less, V: 0.005% or more and 0.500% or less, W:0.005% or more and 0.500% or less, B: 0.0003% or more and 0.0050% or less, Ni: 0.005% or more and 1.000% or less, Cr: 0.005% or more and 1.000% or less, Mo: 0.005% or more and 1.000% or less, Cu: 0.005% or more and 1.000% or less, Sn: 0.002% or more and 0.200% or less, Sb: 0.002% or more and 0.200% or less, Ta: 0.001% or more and 0.1000% or less, Ca: 0.0005% or more and 0.0050% or less, Mg: 0.0005% or more and 0.0050% or less, Zr: 0.0005% or more and 0.0050% or less, and REM:

0.0005% or more and 0.0050% or less in terms of percent by mass can be contained with a residue of Fe and inevitable impurities.

[Ti: 0.005% or More and 0.200% or Less]

Ti is an extremely important additive element in the present invention. Ti is effective in precipitation strengthening of the steel, can reduce a hardness difference with a hard second phase (the martensite or the retained austenite) by improving the strength of the ferrite, and can ensure favorable hole expandability. The effect is achieved with a content of Ti of 0.005% or more. However, when the content of Ti is greater than 0.200%, the area fraction of the martensite, which is hard, is excessive; during a hole expansion test, the number of microvoids in grain boundaries of the martensite increases, and, in addition, propagation of cracks proceeds, thus reducing hole expandability. Consequently, when Ti is added, the content thereof is set within a range of 0.005% or more and 0.200% or less and preferably 0.010% or more and 0.100% or less.

[Nb: 0.005% or More and 0.200% or Less, V: 0.005% or More and 0.500% or Less, and W: 0.005% or More and 0.500% or Less]

Nb, V, and W are effective in precipitation strengthening of the steel, and the effect is achieved with a content of each of them of 0.005% or more. Like the effect of Ti addition, the hardness difference with the hard second phase (the martensite or the retained austenite) can be reduced by improving the strength of the ferrite, and favorable hole expandability can be ensured. The effect is achieved with a content of each of Nb, V, and W of 0.005% or more. However, when the content of Nb is greater than 0.100%, and the content of V and W is greater than 0.5%, the area fraction of the martensite, which is hard, is excessive. Thus, during a hole expansion test, the number of microvoids in grain boundaries of the martensite increases, and, in addition, propagation of cracks proceeds, thus reducing hole expandability. Consequently, when Nb is added, the content thereof is set within a range of 0.005% or more and 0.200% or less and preferably 0.010% or more and 0.100% or less. When V and W are added, the content of these is set within a range of 0.005% or more and 0.500% or less.

[B: 0.0003% or More and 0.0050% or Less]

B has an action of inhibiting formation and growth of the ferrite from austenite grain boundaries, can reduce the hardness difference with the hard second phase (the martensite or the retained austenite) by improving the strength of the ferrite, and can ensure favorable hole expandability. The effect is achieved with a content of B of 0.0003% or more. However, when the content of B is greater than 0.0050%, formability reduces. Consequently, when B is added, the content thereof is set within a range of 0.0003% or more and 0.0050% or less and preferably 0.0005% or more and 0.0030% or less.

[Ni: 0.005% or More and 1.000% or Less]

Ni is an element stabilizing the retained austenite, is effective in ensuring favorable ductility, and, in addition, is an element increasing the strength of the steel through solid solution strengthening. The effect is achieved with a content of Ni of 0.005% or more. On the other hand, when Ni is added over a content of 1.000%, the area fraction of the martensite, which is hard, is excessive. Thus, during a hole expansion test, the number of microvoids in grain boundaries of the martensite increases, and, in addition, propagation of cracks proceeds, thus reducing hole expandability. Consequently, when Ni is added, the content of Ni is set within a range of 0.005% or more and 1.000% or less.

[Cr: 0.005% or More and 1.000% or Less and Mo: 0.005% or More and 1.000% or Less]

Cr and Mo have an action of improving the balance between the strength and ductility of the steel and can thus be added as needed. The effect is achieved with a content of Cr of 0.005% or more and a content of Mo of 0.005% or more. However, when they are excessively added over a content of 1.000% for Cr and a content of 1.000% for Mo, the area fraction of the martensite, which is hard, is excessive. Thus, during a hole expansion test, the number of microvoids in grain boundaries of the martensite increases, and, in addition, propagation of cracks proceeds, thus reducing hole expandability. Consequently, when these elements are added, the content of Cr is set within a range of 0.005% or more and 1.000% or less, whereas the content of Mo is set within a range of 0.005% or more and 1.000% or less.

[Cu: 0.005% or More and 1.000% or Less]

Cu is an element effective in strengthening the steel and may be used for strengthening of the steel if it is within a range set in the present invention. The effect is achieved with a content of Cu of 0.005% or more. On the other hand, when Cu is added over a content of 1.000%, the area fraction of the martensite, which is hard, is excessive. Thus, during a hole expansion test, the number of microvoids in grain boundaries of the martensite increases, and, in addition, propagation of cracks proceeds, thus reducing hole expandability. Consequently, when Cu is added, the content of Cu is set within a range of 0.005% or more and 1.000% or less.

[Sn: 0.005% or More and 0.200% or Less and Sb: 0.005% or More and 0.200% or Less]

Sn and Sb are added as needed from the viewpoint of inhibiting decarburization in a region of about a few tens of micrometers of a steel sheet surface layer occurring by the nitriding and oxidation of a steel sheet surface. Such nitriding and oxidation are inhibited, whereby a reduction in the area fraction of the martensite is inhibited on the steel sheet surface, which is effective in ensuring strength and material quality stability. On the other hand, excessive addition over a content of 0.200% for any of these elements brings about a reduction in ductility. Consequently, when Sn and Sb are added, the contents of these are each set within a range of 0.002% or more and 0.200% or less.

[Ta: 0.001% or More and 0.100% or Less]

Like Ti and Nb, Ta forms alloy carbides and alloy carbonitrides to contribute to high strength. In addition, it is considered that Ta is partially solid dissolved in Nb carbides and Nb carbonitrides to form composite precipitates such as (Nb, Ta) and (C, N) and thus produces an effect of significantly inhibiting coarsening of the precipitates and stabilizing contribution to the strength by precipitation strengthening. Thus, Ta is preferably contained. The effect of precipitate stabilization described above is achieved by setting the content of Ta to 0.001% or more. On the other hand, excessive addition of Ta saturates the precipitate stabilization effect and besides increases alloy costs. Consequently, when Ta is added, the content of Ta is set within a range of 0.001% or more and 0.100% or less.

[Ca: 0.0005% or More and 0.0050% or Less, Mg: 0.0005% or More and 0.0050% or Less, Zr: 0.0005% or More and 0.0050% or Less, and REM: 0.0005% or More and 0.0050% or Less]

Ca, Mg, Zr, and REM are elements effective in making the shape of sulfides spherical and remedying an adverse effect of the sulfides on hole expandability. To achieve this effect, they each require a content of 0.0005% or more. However, excessive addition with a content of greater than 0.0050% for each of them brings about an increase in inclusions and the like and causes surface and internal defects and the like. Consequently, when Ca, Mg, Zr, and REM are added, the contents of these are each set within a range of 0.0005% or more and 0.0050% or less.

(2) The following describes a microscopic structure of the high-strength steel sheet according to the present invention.

[Area Fraction of Ferrite: 35% or More and 80% or Less]

To ensure sufficient ductility, the area fraction of the ferrite is required to be set to 35% or more. To ensure a strength of 980 MPa or more, the area fraction of the ferrite, which is soft, is required to be set to 80% or less. The area fraction of the ferrite is preferably set within a range of 40% or more and 75% or less.

[Area Fraction of Martensite: 5% or More and 35% or Less]

To achieve a TS of 980 MPa or more, the area fraction of the martensite is required to be set to 5% or more. To ensure favorable ductility, the area fraction of the martensite is required to be set to 35% or less. The area fraction of the martensite is preferably within a range of 5% or more and 30% or less.

[Area Fraction of Tempered Martensite: 0% or More and 5% or Less]

Tempered martensite is required in order to ensure favorable hole expandability. To achieve a TS of 980 MPa or more, an area fraction of the tempered martensite is required be set to 5% or less. The area fraction of the tempered martensite is preferably within a range of 0% or more and 3% or less. The area fractions of the ferrite, the martensite, and the tempered martensite were determined by polishing a sheet thickness section (an L section) parallel to a rolling direction of the steel sheet, etching the section with 3 vol % nital, observing a sheet thickness ¼ position (a position corresponding to ¼ of a sheet thickness from the steel sheet surface in a depth direction) for ten fields of view with a 2,000-fold magnification using a scanning electron microscope (SEM), calculating area fractions of the respective structures (the ferrite, the martensite, and the tempered martensite) for 10 fields of view using Image-Pro of Media Cybernetics, Inc. using obtained structure images, and averaging those values. In the structure images, the ferrite shows a grey structure (an underlying structure), the martensite shows a white structure, and the tempered martensite shows a structure having a grey internal structure inside white martensite.

[Volume Fraction of Retained Austenite: 8% or More]

To ensure sufficient ductility, a volume fraction of the retained austenite is required to be set to 8% or more. The volume fraction of the retained austenite is preferably within a range of 12% or more. The volume fraction of the retained austenite was determined by, for a plane obtained by polishing the steel sheet to a plane 0.1 mm distant from the sheet thickness ¼ position and then polishing it by additional 0.1 mm by chemical polishing, measuring respective integral intensity ratios of diffraction peaks of the (200), (220), and (311) planes of fcc iron and the (200), (211), and (220) planes of bcc iron using the CoKa line with an X-ray diffraction apparatus, and averaging the obtained nine integral intensity ratios.

[Average Grain Size of Ferrite: 6 μm or Less]

Fining grains of the ferrite contributes to improvement in TS. Thus, to ensure a desired TS, an average grain size of the ferrite is required to be set to 6 μm or less. The average grain size of the ferrite is preferably set within a range of 5 μm or less.

[Average Grain Size of Retained Austenite: 3 or Less]

Fining grains of the retained austenite contributes to improvement in ductility and hole expandability. Thus, to ensure favorable ductility and hole expandability, an average grain size of the retained austenite is required to be set to 3 μm or less. The average grain size of the retained austenite is preferably within a range of 2.5 or less. The average grain sizes of the ferrite, the martensite, and the retained austenite were determined by determining respective areas of ferrite grains, martensite grains, and retained austenite grains, calculating circle-equivalent diameters, and averaging those values using Image-Pro described above. The martensite and the retained austenite were discriminated from each other with Phase Map of electron backscattered diffraction (EBSD).

[Value Obtained by Dividing Area Fraction of Blocky Austenite by Sum of Area Fractions of Lath-Like Austenite and Blocky Austenite of 0.6 or More]

An area fraction of blocky austenite contributes to improvement in the hole expandability. Thus, to ensure favorable hole expandability, a value obtained by dividing the area fraction of the blocky austenite by the sum of area fractions of lath-like austenite and the blocky austenite is required to be set to 0.6 or more. The value obtained by dividing the area fraction of the blocky austenite by the sum of area fractions of lath-like austenite and the blocky austenite is preferably set within a range of 0.8 or more. The blocky austenite referred to here is one with a major axis-to-minor axis aspect ratio of less than 2.0, whereas lath-like austenite indicates one with a major axis-to-minor axis aspect ratio of 2.0 or more. An aspect ratio of the retained austenite was calculated by drawing an oval circumscribing a retained austenite grain and dividing its major axis length by its minor axis length using Photoshop elements 13.

[Value Obtained by Dividing Average Mn Content (% by Mass) in Retained Austenite by Average Mn Content (% by Mass) in Ferrite: 1.5 or More]

That a value obtained by dividing an average Mn content (% by mass) in the retained austenite by an average Mn content (% by mass) in the ferrite is 1.5 or more is an extremely important constituent matter in the present invention. To ensure favorable ductility, the volume fraction of the stable retained austenite in which Mn is concentrated is required to be high. The value obtained by dividing an average Mn content (% by mass) in the retained austenite by an average Mn content (% by mass) in the ferrite is preferably within a range of 2.0 or more. The average Mn content in the retained austenite was determined by quantifying Mn distribution states to the respective phases of a section in the rolling direction at the sheet thickness ¼ position and through averages of quantity analysis results of 30 retained austenite grains and 30 ferrite grains using an electron probe micro analyzer (EPMA).

[Value Obtained by Dividing Average C Content (% by Mass) in Retained Austenite by Average C Content (% by Mass) in Ferrite: 3.0 or More]

That a value obtained by dividing an average C content (% by mass) in the retained austenite by an average C content (% by mass) in the ferrite is 3.0 or more is an extremely important constituent matter in the present invention. To ensure favorable ductility, the volume fraction of the stable retained austenite in which C is concentrated is required to be high. The value obtained by dividing an average C content (% by mass) in the retained austenite by an average C content (% by mass) in the ferrite is preferably set within a range of 5.0 or more. The average C content in the retained austenite was determined by quantifying C distribution states to the respective phases of a section in the rolling direction at the sheet thickness ¼ position and through averages of quantity analysis results of 30 retained austenite grains and 30 ferrite grains using EPMA.

Even when the microscopic structure of the high-strength steel sheet according to the present invention contains bainite, tempered bainite, pearlite, and carbides such as cementite within a range of 10% or less in terms of area fraction apart from the ferrite, martensite, the tempered martensite, and the retained austenite, the effects of the present invention are not impaired.

(3) The following describes manufacturing conditions of the high-strength steel sheet according to the present invention.

[Heating Temperature of Steel Slab]

A heating temperature of a steel slab, which is not limited to a particular temperature, is preferably set within a temperature range of 1,100° C. or more and 1,300° C. or less. Precipitates present in a heating stage of the steel slab will be present as coarse precipitates within a steel sheet to be finally obtained and do not contribute to the strength, and thus Ti- and Nb-based precipitates precipitated during casting are required to be redissolved. When the heating temperature of the steel slab is less than 1,100° C., sufficient solid dissolving of carbides is difficult, causing a problem in that the risk of the occurrence of troubles during hot rolling caused by an increase in a rolling load increases or the like. Thus, the heating temperature of the steel slab is required to be set to 1,100° C. or more. In addition, also from the viewpoint of removing defects such as bubbles and segregation on a slab surface layer, reducing cracks and irregularities on the steel sheet surface, and achieving a smooth steel sheet surface, the heating temperature of the steel slab is required to be set to 1,100° C. or more. On the other hand, when the heating temperature of the steel slab is higher than 1,300° C., scale loss increases along with an increase in the amount of oxidation, and thus the heating temperature of the steel slab is required to be set to 1,300° C. or less. The heating temperature of the steel slab is more preferably set within a temperature range of 1,150° C. or more and 1,250° C. or less.

Although the steel slab is preferably manufactured by continuous casting in order to prevent macrosegregation, it can also be manufactured by ingot making, thin slab casting, or the like. In addition to a conventional method in which a steel slab is manufactured, then once cooled to room temperature, and then reheated, an energy-saving process such as direct feed rolling or direct rolling, which charges the steel slab into a heating furnace without being cooled to room temperature while remaining a hot slab or rolls the steel slab immediately after performing slight heat retention, can also be used without any problem. The steel slab is formed into a sheet bar by coarse rolling on normal conditions; when the heating temperature is set to a lower temperature, the sheet bar is preferably heated using a bar heater or the like before finishing rolling from the viewpoint of preventing troubles during hot rolling.

[Finishing Delivery Temperature in Hot Rolling of Hot Rolling: 750° C. or More and 1,000° C. or Less]

The steel slab after heating is hot rolled by coarse rolling and finishing rolling to be a hot rolled steel sheet. In this process, when a finishing delivery temperature in hot rolling is higher than 1,000° C., the production of oxides (scales) rapidly increases, the interface between base iron and the oxides roughens, and thus surface quality after pickling and cold rolling tends to degrade. When residues of hot rolling scales or the like are partially present after the pickling, the ductility and hole expandability are adversely affected. In addition, grain size may excessively be coarse, and pressed article surface roughness may occur during the working. On the other hand, when the finishing delivery temperature in hot rolling is less than 750° C., the rolling load increases to increase a rolling burden. In addition, a rolling reduction ratio in a state in which austenite is non-recrystallized increases, the average grain size of the ferrite coarsens, in addition, an abnormal texture develops, in-plane anisotropy in a final product is conspicuous, and not only the uniformity of material quality (material quality stability) is impaired, but also it is difficult to ensure the strength and ductility. Consequently, the finishing delivery temperature in hot rolling of hot rolling is set within a temperature range of 750° C. or more and 1,000° C. or less and preferably 800° C. or more and 950° C. or less.

[Average Coiling Temperature in Coil after Hot Rolling: 300° C. or More and 750° C. or Less]

When an average coiling temperature in coil after the hot rolling is higher than 750° C., the grain size of ferrite of a hot rolled steel sheet structure increases, making it difficult to ensure desired strength and ductility of a final annealed sheet. On the other hand, when the average coiling temperature in coil after the hot rolling is less than 300° C., hot rolled steel sheet strength increases, which increases a rolling load in cold rolling or causes faulty sheet shape, and thus productivity is reduced. Consequently, the average coiling temperature in coil after the hot rolling is set within a temperature range of 300° C. or more and 750° C. or less and preferably 400° C. or more and 650° C. or less. During the hot rolling, coarsely rolled steel sheets may be joined together to continuously perform the finishing rolling. The coarsely rolled steel sheet may once be wound up. To reduce the rolling load during the hot rolling, part or the whole of the finishing rolling may be lubricating rolling. Performing the lubricating rolling is effective also from the viewpoint of making steel sheet shape and material quality uniform. A friction coefficient during the lubricating rolling is preferably set within a range of 0.10 or more and 0.25 or less. The thus manufactured hot rolled steel sheet is subjected to pickling. The pickling can remove oxides on the steel sheet surface and is thus important for ensuring favorable chemical conversion treatability and coating quality of a high-strength steel sheet as a final product. The pickling may be performed once, or the pickling may be performed separately a plurality of times.

[Holding for More than 21,600 s within Temperature Range of $Ac_1$ Transformation Temperature or More and $Ac_1$ Transformation Temperature+150° C. or Less]

Holding for more than 21,600 s within a temperature range of an $Ac_1$ transformation temperature or more and the $Ac_1$ transformation temperature+150° C. or less is an extremely important invention constituent matter in the present invention. In the case of holding within a temperature range of less than the $Ac_1$ transformation temperature, within a temperature range of higher than the $Ac_1$ transformation temperature+150° C., and for less than 21600 s, concentration of Mn into the austenite does not sufficiently proceed, making it difficult to ensure a sufficient volume fraction of the retained austenite after final annealing, and the ductility of the steel reduces. The holding time is preferably 129,600 s or less. In the case of holding for over 129,600 s, concentration of Mn into the austenite is saturated, and not only an effect allowance for ductility after the final annealing reduces, but also cost may increase. The method of heat treatment may be any method of annealing of continuous annealing and batch annealing. After the heat treatment, the steel is cooled to room temperature; the method of cooling and the rate of cooling are not fixed to particular ones, and any cooling may be used including furnace cooling and air cooling in the batch annealing and gas jet cooling, mist cooling, and water cooling in the continuous annealing. When pickling treatment is performed, a normal method may be used.

[Holding for 20 s or More and 900 s or Less within Temperature Range of $Ac_1$ Transformation Temperature or More]

After the cold rolling, annealing treatment holding for 20 s or more and 900 s or less within a temperature range of the $Ac_1$ transformation temperature or more is performed as needed. In the case of falling within a temperature range of less than the $Ac_1$ transformation temperature, holding for less than 20 s, and holding for over 900 s, concentration of Mn into the austenite does not sufficiently proceed, making it difficult to ensure a sufficient volume fraction of the retained austenite after the final annealing, and the ductility of the steel reduces.

[Holding for 20 s or More and 900 s or Less within Temperature Range of $Ac_1$ Transformation Temperature or More and $Ac_1$ Transformation Temperature+150° C. or Less]

Holding for 20 s or more and 900 s or less within a temperature range of the $Ac_1$ transformation temperature or more and the $Ac_1$ transformation temperature+150° C. or less is an extremely important invention constituent matter in the present invention. In the case of holding within a temperature range of less than the $Ac_1$ transformation temperature and for less than 20 s, carbides formed during temperature rising remain undissolved, making it difficult to ensure a sufficient volume fraction of the retained austenite, and the ductility of the steel reduces. In addition, the area fraction of the ferrite increases, making it difficult to ensure strength. On the other hand, in the case of holding within a temperature range of higher than the $Ac_1$ transformation temperature+150° C. and for over 900 s, concentration of Mn into the austenite does not sufficiently proceed, making it unable to obtain a sufficient volume fraction of the retained austenite for the ensuring of ductility. In addition, the area fraction of the martensite increases, strength increases, making it difficult to ensure ductility. The upper limit of the temperature range is preferably the $Ac_1$ transformation temperature+100° C. or less.

[Performing Coating Treatment]

When hot-dip galvanization treatment is performed, the steel sheet that has been subjected to the annealing treatment is immersed in a hot-dip galvanization bath within a temperature range of 440° C. or more and 500° C. or less to perform the hot-dip galvanization treatment, and then a coating adhesion amount is adjusted by gas wiping or the like. As the hot-dip galvanization bath, a hot-dip galvanization bath with the content of Al within a range of 0.08% or more and 0.30% or less is preferably used. When galvannealing treatment for hot-dip galvanization is performed, after the hot-dip galvanization treatment, the galvannealing treatment for hot-dip galvanization is performed within a temperature range of 450° C. or more and 600° C. or less. When the galvannealing treatment is performed at a temperature higher than 600° C., untransformed austenite transforms into pearlite, thus a desired volume fraction of the retained austenite cannot be ensured, and thus the ductility of the steel may reduce. Consequently, when the galvannealing treatment for hot-dip galvanization is performed, the galvannealing treatment for hot-dip galvanization is preferably performed within a temperature range of 450° C. or more and 600° C. or less. Other conditions of the method of manufacture are not limited to particular ones; from the viewpoint of productivity, the annealing treatment is preferably performed with continuous annealing equipment. A series of pieces of treatment including annealing, hot-dip galvanization, and galvannealing treatment for galvanization are preferably performed with a continuous galvanizing line (CGL) as a hot-dip galvanization line.

When a high-strength hot-dip galvanized steel sheet and a high-strength alloyed hot-dip galvanized steel sheet are manufactured, pickling treatment is performed before the heating treatment immediately before the coating (between after hot rolling coiling up and the first heat treatment or between the heat treatment immediately before the coating (the third heat treatment) and its immediately previous heat treatment (the second heat treatment), for example), whereby finally favorable coating quality is obtained. This is because oxides are inhibited from being present on the surface immediately before the coating treatment, and thus uncoating by the oxides is inhibited. More specifically, this is because easily oxidizable elements (such as Mn, Cr, and Si) form oxides to be concentrated on the steel sheet surface during the heat treatment, and thus an easily oxidizable element depletion layer is formed on the steel sheet surface (immediately below the oxides) after the heat treatment, and when the oxides by the easily oxidizable elements are removed by the subsequent pickling treatment, the easily oxidizable element depletion layer appears on the steel sheet surface, and surface oxidation of the easily oxidizable elements is inhibited during the subsequent third heat treatment.

"The high-strength steel sheet" and "the high-strength hot-dip galvanized steel sheet" may be subjected to skin pass rolling for the purpose of, for example, shape correction and surface roughness adjustment. A rolling reduction ratio of the skin pass rolling is preferably set within a range of 0.1% or more and 2.0% or less. In the case of a rolling reduction ratio of less than 0.1%, the effect is small, and control is difficult, and thus this is the lower limit of a favorable range. When the rolling reduction ratio is greater than 2.0%, productivity significantly reduces, and thus this is set to the upper limit of the favorable range. The skin pass rolling may be performed online or performed offline. The skin pass rolling with a target rolling reduction ratio may be performed once or may be performed separately a plurality of times. Various kinds of coating treatment such as resin or oil-and-fat coating can be performed.

EXAMPLES

Steels having component compositions listed in Table 1 with a residue of Fe and inevitable impurities were melted with a converter to make slabs by continuous casting. The obtained slabs were reheated up to 1,250° C. and were then subjected to, on conditions listed in Table 2, hot rolling, annealing at the $Ac_1$ transformation temperature or more, cold rolling, annealing within a temperature range of the $Ac_1$ transformation temperature or more and the $Ac_1$ transformation temperature+150° C. or less to obtain high-strength cold rolled steel sheets (CR) and, in addition, were subjected to galvanization treatment to obtain hot-dip galvanized steel sheets (GI) and hot-dip galvannealed steel sheets (GA). As hot-dip galvanization baths, an Al: 0.19% by mass-containing zinc bath was used for the hot-dip galvanized steel sheets (GI), whereas an Al: 0.14% by mass-containing zinc bath was used for the hot-dip galvannealed steel sheets (GA), with a bath temperature of 465° C. A coating adhesion amount was set to 45 g/m$^2$ per one side (double-sided coating), and for GA, an Fe concentration in a coating layer was adjusted so as to be within a range of 9% by mass or more and 12% by mass or less. The sectional microscopic structure, tensile characteristics, hole expandability, chemical conversion treatability, and coatability of the obtained steel sheets were evaluated. Table 3 lists evaluation results.

TABLE 1

| Steel | Component composition (% by mass) | | | | | | | | | | | | | |
|---|---|---|---|---|---|---|---|---|---|---|---|---|---|---|
| type | C | Si | Mn | P | S | N | Al | Ti | Nb | V | W | B | Ni | Cr |
| A | 0.159 | 0.58 | 3.33 | 0.024 | 0.0020 | 0.0037 | 0.031 | 0.048 | — | — | — | — | — | — |
| B | 0.182 | 0.75 | 3.12 | 0.029 | 0.0021 | 0.0034 | 0.048 | 0.042 | — | — | — | — | — | — |
| C | 0.171 | 1.84 | 3.61 | 0.022 | 0.0019 | 0.0041 | 0.048 | 0.032 | — | — | — | — | — | — |
| D | 0.235 | 0.99 | 3.11 | 0.027 | 0.0018 | 0.0029 | 0.036 | — | — | — | — | — | — | — |
| E | 0.034 | 0.77 | 4.01 | 0.021 | 0.0027 | 0.0031 | 0.049 | — | — | — | — | — | — | — |
| F | 0.180 | 2.81 | 3.85 | 0.027 | 0.0021 | 0.0034 | 0.0036 | — | — | — | — | — | — | — |
| G | 0.166 | 0.02 | 3.25 | 0.026 | 0.0020 | 0.0021 | 0.039 | 0.186 | — | — | — | — | — | — |
| H | 0.208 | 0.67 | 4.16 | 0.021 | 0.0026 | 0.0034 | 0.040 | — | — | — | — | — | — | — |
| I | 0.150 | 1.76 | 3.14 | 0.021 | 0.0027 | 0.0033 | 0.045 | — | — | — | — | — | — | — |
| J | 0.012 | 2.21 | 3.82 | 0.029 | 0.0026 | 0.0032 | 0.032 | — | — | — | — | — | — | — |
| K | 0.202 | 4.22 | 3.49 | 0.028 | 0.0027 | 0.0034 | 0.033 | — | — | — | — | — | — | — |
| L | 0.186 | 0.67 | 6.13 | 0.024 | 0.0029 | 0.0035 | 0.034 | — | — | — | — | — | — | — |
| M | 0.204 | 0.33 | 3.82 | 0.022 | 0.0026 | 0.0038 | 0.219 | 0.032 | — | — | — | — | — | — |
| N | 0.172 | 0.61 | 3.81 | 0.025 | 0.0024 | 0.0035 | 0.048 | 0.001 | — | — | — | — | — | — |
| O | 0.182 | 0.89 | 3.51 | 0.028 | 0.0027 | 0.0034 | 0.048 | 0.013 | 0.043 | — | — | — | — | — |
| P | 0.200 | 1.14 | 3.64 | 0.027 | 0.0023 | 0.0037 | 0.048 | — | — | 0.060 | — | — | — | — |
| Q | 0.115 | 1.22 | 4.10 | 0.028 | 0.0022 | 0.0032 | 0.044 | — | — | — | 0.018 | — | — | — |
| R | 0.140 | 0.35 | 4.09 | 0.031 | 0.0020 | 0.0028 | 0.048 | 0.019 | — | — | — | 0.0014 | — | — |
| S | 0.200 | 0.69 | 3.96 | 0.028 | 0.0022 | 0.0032 | 0.033 | 0.066 | — | — | — | — | 0.299 | — |
| T | 0.099 | 0.54 | 3.39 | 0.025 | 0.0025 | 0.0036 | 0.041 | 0.062 | — | — | — | — | — | 0.345 |
| U | 0.102 | 1.45 | 3.12 | 0.031 | 0.0026 | 0.0035 | 0.032 | 0.024 | — | — | — | — | — | — |
| V | 0.109 | 0.56 | 3.63 | 0.026 | 0.0032 | 0.0034 | 0.040 | — | — | — | — | — | — | — |
| W | 0.121 | 0.59 | 3.19 | 0.027 | 0.0022 | 0.0035 | 0.035 | 0.035 | — | — | — | — | — | — |
| X | 0.160 | 0.48 | 3.25 | 0.025 | 0.0021 | 0.0068 | 0.034 | 0.089 | — | — | — | — | — | — |
| Y | 0.198 | 0.69 | 3.59 | 0.029 | 0.0017 | 0.0044 | 0.031 | — | — | — | — | — | — | — |
| Z | 0.204 | 0.43 | 3.23 | 0.027 | 0.0027 | 0.0037 | 0.030 | — | 0.032 | — | — | — | — | — |
| AA | 0.213 | 0.29 | 3.76 | 0.026 | 0.0025 | 0.0044 | 0.050 | — | 0.038 | — | — | — | — | — |
| AB | 0.214 | 0.97 | 4.02 | 0.031 | 0.0028 | 0.0045 | 0.042 | — | — | — | — | — | — | — |
| AC | 0.199 | 1.28 | 3.85 | 0.032 | 0.0029 | 0.0041 | 0.037 | — | — | — | — | — | — | — |
| AD | 0.242 | 0.05 | 3.12 | 0.030 | 0.0022 | 0.0034 | 0.040 | 0.011 | — | — | — | — | — | — |
| AE | 0.082 | 0.07 | 4.12 | 0.029 | 0.0024 | 0.0033 | 0.048 | — | — | — | — | — | — | — |

| Steel | Component composition (% by mass) | | | | | | | | | $Ac_1$ transformation temperature | $Ac_3$ transformation temperature | Re- |
|---|---|---|---|---|---|---|---|---|---|---|---|---|
| Type | Mo | Cu | Sn | Sb | Ta | Ca | Mg | Zr | REM | (° C.) | (° C.) | marks |
| A | — | — | — | — | — | — | — | — | — | 662 | 781 | Example steel |
| B | — | — | — | — | — | — | — | — | — | 669 | 790 | Example steel |
| C | — | — | — | — | — | — | — | — | — | 667 | 823 | Example steel |
| D | — | — | — | — | — | — | — | — | — | 671 | 770 | Example steel |
| E | — | — | — | — | — | — | — | — | — | 647 | 797 | Example steel |
| F | — | — | — | — | — | — | — | — | — | 671 | 842 | Example steel |
| G | — | — | — | — | — | — | — | — | — | 658 | 813 | Example steel |
| H | — | — | — | — | — | — | — | — | — | 639 | 731 | Example steel |
| I | — | — | — | — | — | — | — | — | — | 680 | 825 | Example steel |
| J | — | — | — | — | — | — | — | — | — | 668 | 879 | Comparative steel |
| K | — | — | — | — | — | — | — | — | — | 696 | 911 | Comparative steel |
| L | — | — | — | — | — | — | — | — | — | 584 | 676 | Comparative steel |

TABLE 1-continued

| | | | | | | | | | | | | |
|---|---|---|---|---|---|---|---|---|---|---|---|---|
| M | — | — | — | — | — | — | — | — | — | 644 | 775 | Example steel |
| N | — | — | — | — | — | — | — | — | — | 648 | 749 | Comparative steel |
| O | — | — | — | — | — | — | — | — | — | 660 | 773 | Example steel |
| P | — | — | — | — | — | — | — | — | — | 658 | 777 | Example steel |
| Q | — | — | — | — | — | — | — | — | — | 648 | 782 | Example steel |
| R | — | — | — | — | — | — | — | — | — | 638 | 744 | Example steel |
| S | — | — | — | — | — | — | — | — | — | 640 | 760 | Example steel |
| T | — | — | — | — | — | — | — | — | — | 665 | 781 | Example steel |
| U | 0.522 | — | — | — | — | — | — | — | — | 680 | 850 | Example steel |
| V | — | 0.274 | — | — | — | — | — | — | — | 654 | 762 | Example steel |
| W | — | — | 0.006 | — | — | — | — | — | — | 666 | 791 | Example steel |
| X | — | — | — | 0.008 | — | — | — | — | — | 663 | 795 | Example steel |
| Y | — | — | — | — | 0.005 | — | — | — | — | 655 | 749 | Example steel |
| Z | — | — | 0.007 | — | — | — | — | — | — | 662 | 747 | Example steel |
| AA | — | — | — | — | 0.008 | — | — | — | — | 646 | 727 | Example steel |
| AB | — | — | — | — | — | 0.0023 | — | — | — | 646 | 748 | Example steel |
| AC | — | — | — | — | — | — | 0.0021 | — | — | 654 | 769 | Example steel |
| AD | — | — | — | — | — | — | — | 0.0028 | — | 660 | 731 | Example steel |
| AE | — | — | — | — | — | — | — | — | 0.0025 | 635 | 741 | Example steel |

Underlined parts each indicate being out of the range of the present invention
each indicate a content at an inevitable impurity level.

TABLE 2

| No. | Steel type | Finishing delivery temperature in hot rolling (° C.) | Average coiling temperature in coil (° C.) | Hot rolled sheet heat treatment: Heat treatment temperature (° C.) | Hot rolled sheet heat treatment: Heat treatment time (s) | Reduction ratio in cold rolling (%) | Cold rolled sheet annealing treatment: Heat treatment temperature (° C.) | Cold rolled sheet annealing treatment: Heat treatment times(s) | Cold rolled sheet anneling treatment: Heat treatment temperature (° C.) | Cold rolled sheet anneling treatment: Heat treatment time(s) | Galvannealed temperature (° C.) | Type* | Remarks |
|---|---|---|---|---|---|---|---|---|---|---|---|---|---|
| 1 | A | 850 | 500 | 700 | 36000 | 55.6 | 720 | 300 | | | | CR | Example |
| 2 | A | 880 | 450 | 750 | 23400 | 57.9 | | | 740 | 240 | | GI | Example |
| 3 | A | 900 | 475 | 770 | 28800 | 64.7 | | | 730 | 270 | 520 | GA | Example |
| 4 | A | 850 | 450 | 700 | 32400 | 58.8 | 780 | 360 | | | | CR | Example |
| 5 | A | 880 | 500 | 680 | 36000 | 66.7 | | | 790 | 300 | | GI | Example |
| 6 | A | 900 | 550 | 700 | 64800 | 53.3 | | | 800 | 320 | 500 | GA | Example |
| 7 | A | 860 | 520 | 720 | 23400 | 62.5 | | | 580 | 240 | 530 | GA | Comparative example |
| 8 | A | 860 | 480 | 720 | 32400 | 58.8 | | | 910 | 450 | 520 | GA | Comparative example |
| 9 | A | 880 | 510 | 750 | 36000 | 57.6 | 780 | 500 | 700 | 500 | 520 | GA | Example |
| 10 | B | 890 | 500 | 690 | 23400 | 54.8 | 700 | 300 | 680 | 300 | | GI | Example |
| 11 | C | 900 | 520 | 690 | 28800 | 52.9 | 720 | 350 | 720 | 350 | | GI | Example |
| 12 | A | 710 | 540 | 680 | 32400 | 47.1 | 720 | 250 | 700 | 250 | 540 | GA | Comparative example |
| 13 | A | 910 | 850 | 700 | 43200 | 56.5 | 740 | 800 | 680 | 800 | 510 | GA | Comparative example |
| 14 | A | 870 | 510 | 500 | 32400 | 64.7 | 680 | 700 | 675 | 700 | | GI | Comparative example |
| 15 | A | 880 | 580 | 850 | 36000 | 58.8 | 700 | 500 | 740 | 500 | 460 | GA | Comparative example |
| 16 | A | 890 | 490 | 680 | 7200 | 50.0 | 750 | 600 | 750 | 600 | | GI | Comparative example |

TABLE 2-continued

| No. | Steel type | Finishing delivery temperature in hot rolling (° C.) | Average coiling temperature in coil (° C.) | Hot rolled sheet heat treatment: Heat treatment temperature (° C.) | Hot rolled sheet heat treatment: Heat treatment time (s) | Reduction ratio in cold rolling (%) | Cold rolled sheet annealing treatment: Heat treatment temperature (° C.) | Cold rolled sheet annealing treatment: Heat treatment times(s) | Cold rolled sheet anneling treatment: Heat treatment temperature (° C.) | Cold rolled sheet anneling treatment: Heat treatment time(s) | Galvannealed temperature (° C.) | Type* | Remarks |
|---|---|---|---|---|---|---|---|---|---|---|---|---|---|
| 17 | A | 890 | 600 | 700 | 85400 | 52.9 | 520 | 550 | 680 | 550 | | GI | Comparative example |
| 18 | A | 880 | 590 | 660 | 23400 | 57.1 | 680 | 10 | 710 | 750 | | GI | Comparative example |
| 19 | A | 880 | 560 | 680 | 108000 | 51.7 | 700 | 950 | 700 | 400 | | GI | Comparative example |
| 20 | A | 860 | 560 | 680 | 57600 | 58.8 | 720 | 300 | 550 | 300 | 530 | GA | Comparative example |
| 21 | A | 870 | 550 | 700 | 64800 | 68.4 | 750 | 350 | 850 | 450 | 500 | GA | Comparative example |
| 22 | A | 850 | 480 | 710 | 36000 | 61.1 | 740 | 250 | 680 | 10 | 520 | GA | Comparative example |
| 23 | A | 840 | 400 | 640 | 32400 | 64.7 | 720 | 350 | 710 | 1200 | | GI | Comparative example |
| 24 | D | 910 | 600 | 700 | 23400 | 58.8 | 750 | 800 | 780 | 300 | | GI | Example |
| 25 | E | 870 | 620 | 680 | 43200 | 58.8 | 680 | 620 | 680 | 600 | | GI | Example |
| 26 | F | 900 | 590 | 720 | 32400 | 57.1 | 720 | 700 | 720 | 350 | | GI | Example |
| 27 | F | 890 | 600 | 710 | 32400 | 57.1 | 700 | 600 | 700 | 360 | 580 | GA | Example |
| 28 | G | 910 | 560 | 730 | 36000 | 50.0 | 780 | 500 | 700 | 400 | 480 | GA | Example |
| 29 | H | 880 | 600 | 650 | 23400 | 52.9 | 800 | 550 | 670 | 450 | | GI | Example |
| 30 | I | 870 | 560 | 640 | 28800 | 48.6 | 790 | 540 | 740 | 650 | | GI | Example |
| 31 | J | 910 | 580 | 680 | 57600 | 46.2 | 780 | 290 | 680 | 200 | | GI | Comparative example |
| 32 | K | 870 | 610 | 660 | 23400 | 62.5 | 700 | 300 | 710 | 250 | 580 | GA | Comparative example |
| 33 | K | 850 | 600 | 680 | 28800 | 62.5 | 720 | 300 | | | | CR | Comparative example |
| 34 | L | 880 | 520 | 700 | 32400 | 58.8 | 620 | 210 | 650 | 300 | 510 | GA | Comparative example |
| 35 | M | 900 | 520 | 700 | 23400 | 62.5 | 700 | 360 | 690 | 360 | 480 | GA | Example |
| 36 | N | 850 | 560 | 720 | 36000 | 56.3 | 680 | 300 | 700 | 280 | | GI | Comparative example |
| 37 | O | 900 | 580 | 660 | 28800 | 64.7 | 700 | 370 | 700 | 300 | | GI | Example |
| 38 | P | 850 | 600 | 680 | 57600 | 50.0 | 750 | 400 | 720 | 330 | | GI | Example |
| 39 | Q | 840 | 550 | 690 | 32400 | 46.2 | 750 | 300 | 720 | 600 | 520 | GA | Example |
| 40 | R | 860 | 550 | 700 | 36000 | 52.9 | 720 | 320 | 730 | 360 | | GI | Example |
| 41 | S | 850 | 560 | 710 | 23400 | 47.1 | 740 | 300 | 700 | 300 | 510 | GA | Example |
| 42 | T | 900 | 610 | 690 | 28800 | 55.6 | 760 | 300 | 680 | 300 | 520 | GA | Example |
| 43 | U | 840 | 540 | 700 | 57600 | 56.3 | 780 | 200 | 750 | 200 | | GI | Example |
| 44 | V | 870 | 520 | 720 | 23400 | 58.8 | 780 | 250 | 700 | 250 | | GI | Example |
| 45 | W | 880 | 500 | 680 | 23400 | 64.7 | 720 | 280 | 700 | 270 | | GI | Example |
| 46 | X | 900 | 500 | 680 | 108000 | 62.5 | 690 | 250 | 690 | 250 | 520 | GA | Example |
| 47 | Y | 910 | 600 | 700 | 28800 | 56.3 | 700 | 300 | 740 | 300 | 510 | GA | Example |
| 48 | Z | 920 | 580 | 700 | 36000 | 53.8 | 720 | 340 | 720 | 340 | 520 | GA | Example |
| 49 | AA | 900 | 560 | 680 | 32400 | 56.3 | 700 | 600 | 660 | 600 | | GI | Example |
| 50 | AB | 900 | 550 | 710 | 126000 | 56.3 | 750 | 500 | 680 | 450 | 520 | GA | Example |
| 51 | AC | 850 | 550 | 690 | 36000 | 56.3 | 800 | 500 | 740 | 420 | | GI | Example |
| 52 | AD | 880 | 520 | 750 | 63000 | 64.7 | 750 | 250 | 700 | 360 | 480 | GA | Example |
| 53 | AE | 820 | 500 | 680 | 39600 | 60.0 | 750 | 350 | 680 | 300 | | GI | Example |

Underlined parts each indicate being out of the range of the present invention.

*CR: Cold rolled steel sheet (without coating),

GI: Hot-dip galvanized steel sheet (galvanization without galvannealing treatment), GA: Hot-dip galvannealed steel sheet

TABLE 3

| No. | Steel type | Sheet thickness (mm) | Area fraction of F (%) | Area fraction of M (%) | Area fraction of TM (%) | Volume fraction of RA (%) | Average grain size of F (μm) | Average grain size of RA (μm) | Average Mn content in RA (% by mass) | Average Mn content in F (% by mass) | Average Mn content in RA/average Mn content in F | Average C content in RA (% by mass) | Average C content in F (% by mass) | Average C content in RA/average C content in F |
|---|---|---|---|---|---|---|---|---|---|---|---|---|---|---|
| 1 | A | 1.6 | 55.5 | 18.5 | 2.8 | 20.8 | 5.9 | 1.0 | 5.86 | 1.20 | 4.88 | 0.49 | 0.07 | 6.91 |
| 2 | A | 1.6 | 51.2 | 19.6 | 3.4 | 21.5 | 5.0 | 2.3 | 6.20 | 2.13 | 2.91 | 0.40 | 0.05 | 8.00 |
| 3 | A | 1.2 | 54.4 | 19.8 | 4.0 | 21.3 | 4.0 | 1.7 | 5.64 | 1.88 | 3.00 | 0.38 | 0.07 | 5.60 |

TABLE 3-continued

| | | | | | | | | | | | | | | |
|---|---|---|---|---|---|---|---|---|---|---|---|---|---|---|
| 4 | A | 1.4 | 48.9 | 28.2 | 1.2 | 15.4 | 2.3 | 1.4 | 5.00 | 2.94 | 1.70 | 0.31 | 0.09 | 3.44 |
| 5 | A | 1.2 | 49.9 | 30.4 | 0.7 | 13.7 | 5.2 | 2.5 | 4.65 | 2.64 | 1.76 | 0.32 | 0.10 | 3.20 |
| 6 | A | 1.4 | 50.7 | 32.8 | 0.2 | 13.3 | 5.2 | 1.8 | 4.67 | 2.72 | 1.72 | 0.29 | 0.07 | 4.14 |
| 7 | A | 1.2 | 82.1 | 10.4 | 1.6 | 4.2 | 4.7 | 2.5 | 3.78 | 3.00 | 1.26 | 0.16 | 0.10 | 1.60 |
| 8 | A | 1.4 | 44.0 | 45.4 | 4.8 | 3.9 | 3.5 | 1.0 | 3.91 | 3.24 | 1.21 | 0.18 | 0.12 | 1.50 |
| 9 | A | 1.4 | 58.4 | 16.5 | 4.4 | 20.5 | 3.4 | 0.7 | 6.94 | 2.52 | 2.75 | 0.37 | 0.08 | 4.73 |
| 10 | B | 1.4 | 65.4 | 12.9 | 0.8 | 17.2 | 2.3 | 2.5 | 6.18 | 3.03 | 2.04 | 0.41 | 0.06 | 5.57 |
| 11 | C | 1.6 | 59.6 | 14.5 | 3.1 | 20.9 | 2.8 | 1.2 | 6.69 | 2.08 | 3.21 | 0.47 | 0.06 | 7.45 |
| 12 | A | 1.8 | 64.1 | 11.7 | 3.1 | 19.8 | 8.2 | 2.9 | 5.62 | 1.37 | 4.09 | 0.20 | 0.06 | 3.55 |
| 13 | A | 1.4 | 66.7 | 15.2 | 3.8 | 13.5 | 7.5 | 4.5 | 6.00 | 1.41 | 4.26 | 0.31 | 0.08 | 3.88 |
| 14 | A | 1.2 | 50.9 | 32.1 | 1.8 | 6.8 | 2.8 | 1.2 | 4.15 | 3.21 | 1.29 | 0.30 | 0.11 | 2.73 |
| 15 | A | 1.4 | 60.9 | 25.1 | 1.7 | 6.2 | 2.4 | 0.3 | 4.24 | 3.26 | 1.30 | 0.42 | 0.09 | 4.79 |
| 16 | A | 1.2 | 61.6 | 28.8 | 1.1 | 7.2 | 4.3 | 0.6 | 4.00 | 3.15 | 1.27 | 0.32 | 0.08 | 3.94 |
| 17 | A | 1.6 | 56.2 | 24.3 | 3.9 | 7.5 | 2.8 | 2.6 | 4.15 | 2.88 | 1.44 | 0.31 | 0.04 | 7.57 |
| 18 | A | 1.2 | 58.1 | 25.8 | 0.9 | 6.0 | 2.9 | 1.3 | 4.23 | 3.16 | 1.34 | 0.31 | 0.03 | 9.09 |
| 19 | A | 1.4 | 61.7 | 29.4 | 0.2 | 7.1 | 4.3 | 1.6 | 3.95 | 3.10 | 1.27 | 0.23 | 0.06 | 3.76 |
| 20 | A | 1.4 | 85.6 | 8.3 | 0.6 | 5.4 | 5.1 | 1.7 | 5.28 | 2.52 | 2.09 | 0.43 | 0.10 | 4.30 |
| 21 | A | 1.2 | 33.7 | 46.0 | 4.7 | 7.1 | 4.1 | 2.7 | 4.01 | 3.14 | 1.28 | 0.50 | 0.06 | 8.91 |
| 22 | A | 1.4 | 83.4 | 10.7 | 1.3 | 3.5 | 3.3 | 0.9 | 7.22 | 1.52 | 4.77 | 0.37 | 0.06 | 6.46 |
| 23 | A | 1.2 | 33.0 | 42.6 | 0.1 | 6.1 | 4.5 | 1.1 | 3.99 | 3.20 | 1.25 | 0.54 | 0.09 | 5.70 |
| 24 | D | 1.4 | 57.8 | 17.0 | 3.0 | 19.9 | 5.5 | 1.5 | 6.23 | 3.20 | 1.95 | 0.62 | 0.06 | 10.80 |
| 25 | E | 1.4 | 53.9 | 20.2 | 2.7 | 20.7 | 5.8 | 1.0 | 6.81 | 3.50 | 1.94 | 0.32 | 0.07 | 4.57 |
| 26 | F | 1.2 | 43.8 | 26.2 | 2.3 | 20.1 | 4.1 | 2.9 | 7.31 | 1.43 | 5.11 | 0.63 | 0.07 | 8.86 |
| 27 | F | 1.2 | 44.5 | 24.2 | 1.8 | 21.2 | 3.9 | 2.5 | 7.51 | 1.33 | 5.65 | 0.61 | 0.08 | 7.63 |
| 28 | G | 1.4 | 41.3 | 27.5 | 4.4 | 18.5 | 4.4 | 1.4 | 3.99 | 2.15 | 1.86 | 0.29 | 0.05 | 5.80 |
| 29 | H | 1.6 | 52.8 | 18.7 | 1.3 | 21.6 | 3.9 | 1.5 | 7.33 | 2.07 | 3.54 | 0.33 | 0.07 | 4.86 |
| 30 | I | 1.8 | 53.3 | 23.7 | 2.4 | 18.1 | 5.3 | 2.3 | 5.37 | 2.80 | 1.91 | 0.45 | 0.05 | 9.33 |
| 31 | J | 1.4 | 83.5 | 4.5 | 0.6 | 3.3 | 2.9 | 1.0 | 6.73 | 2.78 | 2.42 | 0.21 | 0.02 | 8.55 |
| 32 | K | 1.2 | 56.8 | 13.6 | 4.4 | 19.1 | 2.7 | 0.3 | 7.36 | 2.85 | 2.58 | 0.30 | 0.08 | 3.66 |
| 33 | K | 1.2 | 57.2 | 13.3 | 3.9 | 20.8 | 2.9 | 0.7 | 7.25 | 2.88 | 2.52 | 0.29 | 0.09 | 3.22 |
| 34 | L | 1.4 | 50.4 | 24.4 | 3.5 | 15.3 | 2.5 | 1.3 | 6.60 | 2.71 | 2.44 | 0.41 | 0.05 | 7.81 |
| 35 | M | 1.2 | 54.5 | 16.6 | 5.0 | 18.8 | 3.2 | 1.9 | 7.23 | 1.96 | 3.69 | 0.34 | 0.05 | 6.79 |
| 36 | N | 1.4 | 44.3 | 29.6 | 3.9 | 18.3 | 4.0 | 1.1 | 7.09 | 2.46 | 2.88 | 0.38 | 0.07 | 5.27 |
| 37 | O | 1.2 | 52.9 | 14.5 | 3.4 | 21.0 | 3.9 | 0.6 | 6.46 | 1.62 | 3.99 | 0.32 | 0.04 | 8.47 |
| 38 | P | 1.4 | 45.9 | 22.1 | 5.0 | 20.5 | 4.6 | 0.7 | 6.20 | 2.46 | 2.52 | 0.45 | 0.06 | 7.45 |
| 39 | Q | 1.4 | 53.0 | 14.6 | 3.9 | 20.4 | 2.8 | 0.6 | 6.96 | 2.22 | 3.13 | 0.33 | 0.04 | 8.25 |
| 40 | R | 1.6 | 55.1 | 16.8 | 2.6 | 20.6 | 2.5 | 0.4 | 7.64 | 1.19 | 6.41 | 0.47 | 0.05 | 9.50 |
| 41 | S | 1.8 | 54.4 | 16.5 | 4.1 | 20.0 | 3.0 | 0.9 | 7.29 | 1.61 | 4.53 | 0.51 | 0.07 | 7.03 |
| 42 | T | 1.6 | 58.4 | 12.2 | 4.3 | 18.0 | 5.3 | 2.7 | 6.76 | 2.22 | 3.04 | 0.44 | 0.06 | 7.33 |
| 43 | U | 1.4 | 63.8 | 10.3 | 0.1 | 21.5 | 4.2 | 1.9 | 5.39 | 3.28 | 1.65 | 0.36 | 0.05 | 6.97 |
| 44 | V | 1.4 | 50.3 | 22.9 | 3.0 | 19.0 | 4.4 | 0.5 | 6.80 | 2.79 | 2.43 | 0.45 | 0.06 | 7.50 |
| 45 | W | 1.2 | 50.5 | 24.6 | 3.4 | 19.2 | 3.5 | 0.9 | 5.93 | 2.47 | 2.40 | 0.49 | 0.07 | 6.86 |
| 46 | X | 1.2 | 39.7 | 29.4 | 4.4 | 19.9 | 4.6 | 2.3 | 6.47 | 2.78 | 2.33 | 0.52 | 0.06 | 8.67 |
| 47 | Y | 1.4 | 47.1 | 21.8 | 3.1 | 19.7 | 5.5 | 2.9 | 7.06 | 2.74 | 2.57 | 0.59 | 0.10 | 6.08 |
| 48 | Z | 1.2 | 52.9 | 15.7 | 3.7 | 19.6 | 2.4 | 1.2 | 6.01 | 3.51 | 1.71 | 0.47 | 0.05 | 9.40 |
| 49 | AA | 1.4 | 56.1 | 19.7 | 0.5 | 18.2 | 4.9 | 2.8 | 6.88 | 2.57 | 2.68 | 0.44 | 0.05 | 8.80 |
| 50 | AB | 1.4 | 60.0 | 16.2 | 2.7 | 19.8 | 3.8 | 2.9 | 6.11 | 3.06 | 1.99 | 0.52 | 0.07 | 7.01 |
| 51 | AC | 1.4 | 54.6 | 19.9 | 0.7 | 21.3 | 2.5 | 0.7 | 6.80 | 2.82 | 2.41 | 0.49 | 0.08 | 6.13 |
| 52 | AD | 1.2 | 54.7 | 15.6 | 3.5 | 21.7 | 4.8 | 2.5 | 5.55 | 2.89 | 1.92 | 0.55 | 0.08 | 6.88 |
| 53 | AE | 1.2 | 44.2 | 18.4 | 1.0 | 20.9 | 4.4 | 1.7 | 6.88 | 3.70 | 1.86 | 0.25 | 0.08 | 3.11 |

| No. | Area fraction of blocky RA (%) | Area fraction of lath-like RA (%) | Area fraction of blocky RA/ (area fraction of blocky RA + area fraction of lath-like RA) | The other phases | TS (MPa) | EL (%) | λ (Punching) (%) | λ (Reamer) (%) | Chemical conversion treatability | Coatability | Remarks |
|---|---|---|---|---|---|---|---|---|---|---|---|
| 1 | 18.5 | 2.3 | 0.89 | BF, P, θ | 991 | 24.0 | 24 | 49 | 5 | | Example |
| 2 | 16.4 | 5.1 | 0.76 | BF, P, θ | 1013 | 21.5 | 21 | 52 | | Good | Example |
| 3 | 18.0 | 3.3 | 0.85 | BF, P, θ | 1004 | 23.1 | 22 | 53 | | Good | Example |
| 4 | 14.2 | 1.2 | 0.92 | BF, P, θ | 1192 | 13.8 | 15 | 54 | 5 | | Example |
| 5 | 13.5 | 0.2 | 0.99 | BF, P, θ | 1224 | 12.5 | 14 | 56 | | Good | Example |
| 6 | 12.3 | 1.0 | 0.92 | BF, P, θ | 1241 | 12.2 | 13 | 52 | | Good | Example |
| 7 | 3.8 | 0.4 | 0.90 | BF, P, θ | 878 | 20.8 | 25 | 51 | | Good | Comparative example |
| 8 | 3.3 | 0 6 | 0.85 | BF, P, θ | 1341 | 8.0 | 11 | 42 | | Good | Comparative example |
| 9 | 16.4 | 4.1 | 0.80 | BF, P, θ | 995 | 22.0 | 23 | 49 | | Good | Example |
| 10 | 16.8 | 0.4 | 0.98 | BF, P, θ | 990 | 23.4 | 24 | 46 | | Good | Example |
| 11 | 18.1 | 2.8 | 0.87 | BF, P, θ | 1192 | 13.0 | 16 | 50 | | Good | Example |
| 12 | 15.5 | 4.3 | 0.78 | BF, P, θ | 804 | 18.8 | 22 | 46 | | Good | Comparative example |
| 13 | 11.1 | 2.4 | 0.82 | BF, P, θ | 843 | 15.6 | 14 | 59 | | Good | Comparative example |

TABLE 3-continued

| | | | | | | | | | | | |
|---|---|---|---|---|---|---|---|---|---|---|---|
| 14 | 6.0 | 0.8 | 0.88 | BF, P, θ | 1052 | 12.0 | 18 | 56 | | Good | Comparative example |
| 15 | 5.8 | 0.4 | 0.94 | BF, P, θ | 1213 | 10.8 | 14 | 54 | | Good | Comparative example |
| 16 | 5.9 | 1.3 | 0.82 | BF, P, θ | 1244 | 10.0 | 13 | 58 | | Good | Comparative example |
| 17 | 5.5 | 2.0 | 0.73 | BF, P, θ | 1001 | 17.2 | 20 | 55 | | Good | Comparative example |
| 18 | 5.6 | 0.4 | 0.93 | BF, P, θ | 989 | 16.2 | 20 | 48 | | Good | Comparative example |
| 19 | 6.2 | 0.9 | 0.87 | BF, P, θ | 1105 | 11.5 | 18 | 45 | | Good | Comparative example |
| 20 | 5.1 | 0.3 | 0.94 | BF, P, θ | 821 | 29.1 | 28 | 57 | | Good | Comparative example |
| 21 | 6.2 | 0.9 | 0.87 | BF, P, θ | 1256 | 10.8 | 9 | 44 | | Good | Comparative example |
| 22 | 3.1 | 0.4 | 0.89 | BF, P, θ | 848 | 19.4 | 25 | 51 | | Good | Comparative example |
| 23 | 5.5 | 0.6 | 0.90 | BF, P, θ | 1383 | 11.8 | 8 | 52 | | Good | Comparative example |
| 24 | 17.5 | 2.4 | 0.88 | BF, P, θ | 1209 | 17.4 | 17 | 52 | | Good | Example |
| 25 | 17.4 | 3.3 | 0.84 | BF, P, θ | 1002 | 20.8 | 24 | 41 | | Good | Example |
| 26 | 18.1 | 2.0 | 0.90 | BF, P, θ | 1121 | 19.9 | 18 | 47 | | Good | Example |
| 27 | 18.3 | 2.9 | 0.86 | BF, P, θ | 1103 | 20.1 | 17 | 51 | | Fair | Example |
| 28 | 16.6 | 1.9 | 0.90 | BF, P, θ | 985 | 22.5 | 21 | 59 | | Good | Example |
| 29 | 18.8 | 2.8 | 0.87 | BF, P, θ | 1071 | 25.5 | 22 | 58 | | Good | Example |
| 30 | 14.6 | 3.5 | 0.81 | BF, P, θ | 980 | 20.9 | 23 | 47 | | Good | Example |
| 31 | 3.0 | 0.3 | 0.91 | BF, P, θ | 549 | 31.3 | 60 | 56 | | Good | Comparative example |
| 32 | 16.4 | 2.7 | 0.86 | BF, P, θ | 1000 | 13.5 | 10 | 48 | | Poor | Comparative example |
| 33 | 16.5 | 4.3 | 0.79 | BF, P, θ | 996 | 13.7 | 11 | 49 | 2 | | Comparative example |
| 34 | 11.1 | 4.2 | 0.73 | BF, P, θ | 1023 | 25.2 | 20 | 59 | | Poor | Comparative example |
| 35 | 12.8 | 6.0 | 0.68 | BF, P, θ | 1002 | 23.4 | 22 | 53 | | Good | Example |
| 36 | 12.4 | 5.9 | 0.68 | BF, P, θ | 993 | 21.4 | 14 | 49 | | Good | Comparative example |
| 37 | 13.8 | 7.2 | 0.66 | BF, P, θ | 987 | 22.9 | 21 | 50 | | Good | Example |
| 38 | 16.0 | 4.5 | 0.78 | BF, P, θ | 1084 | 19.1 | 18 | 54 | | Good | Example |
| 39 | 15.2 | 5.2 | 0.75 | BF, P, θ | 1101 | 18.8 | 18 | 51 | | Good | Example |
| 40 | 16.0 | 4.6 | 0.78 | BF, P, θ | 1124 | 17.4 | 20 | 55 | | Good | Example |
| 41 | 16.4 | 3.6 | 0.82 | BF, P, θ | 999 | 24.0 | 23 | 54 | | Good | Example |
| 42 | 15.5 | 2.5 | 0.86 | BF, P, θ | 984 | 22.1 | 21 | 52 | | Good | Example |
| 43 | 14.3 | 7.2 | 0.67 | BF, P, θ | 1092 | 17.8 | 18 | 49 | | Good | Example |
| 44 | 18.1 | 0.9 | 0.95 | BF, P, θ | 993 | 23.5 | 21 | 56 | | Good | Example |
| 45 | 17.9 | 1.3 | 0.93 | BF, P, θ | 994 | 23.8 | 22 | 56 | | Good | Example |
| 46 | 14.3 | 5.6 | 0.72 | BF, P, θ | 1034 | 23.0 | 25 | 58 | | Good | Example |
| 47 | 17.7 | 2.0 | 0.90 | BF, P, θ | 1099 | 18.5 | 17 | 60 | | Good | Example |
| 48 | 17.2 | 2.4 | 0.88 | BF, P, θ | 1114 | 13.8 | 16 | 61 | | Good | Example |
| 49 | 14.0 | 4.2 | 0.77 | BF, P, θ | 1050 | 21.5 | 22 | 59 | | Good | Example |
| 50 | 15.3 | 4.5 | 0.77 | BF, P, θ | 1081 | 19.9 | 18 | 60 | | Good | Example |
| 51 | 15.1 | 6.2 | 0.71 | BF, P, θ | 1198 | 15.2 | 15 | 61 | | Good | Example |
| 52 | 13.4 | 8.3 | 0.62 | BF, P, θ | 1012 | 21.4 | 22 | 57 | | Good | Example |
| 53 | 15.2 | 5.7 | 0.73 | BF, P, θ | 996 | 21.1 | 23 | 48 | | Good | Example |

Underlined parts each indicate being out of the range of the present invention
F: Ferrite,
M: Martensite,
TM: Tempered martensite,
RA: Retained austenite,
BF: Bainitic ferrite,
P: Pearlite,
θ: Carbides (such as cementite)

The $Ac_1$ transformation temperature and the $Ac_3$ transformation temperature were determined using the following expressions.

The $Ac_1$ transformation temperature (° C.)=751−16×(% C)+11×(% Si)−28×(% Mn)−5.5×(% Cu)−16×(% Ni)+13×(% Cr)+3.4×(% Mo)

The $Ac_3$ transformation temperature (° C.)=910−203√(% C)+45×(% Si)−30×(% Mn)−20×(% Cu)−15×(% Ni)+11×(% Cr)+32×(% Mo)+104×(% V)+400×(% Ti)+200×(% Al)

Where (% C), (% Si), (% Mn), (% Ni), (% Cu), (% Cr), (% Mo), (% V), (% Ti), and (% Al) are respective contents (% by mass) of the elements.

A tensile test was conducted pursuant to JIS Z 2241 (2011) using a JIS No. 5 test piece sampled so as to cause a tensile direction to be a right-angle direction relative to a rolling direction of the steel sheets to measure tensile strength (TS) and total elongation (EL). The mechanical characteristics were determined to be favorable in the following cases.

TS of 980 MPa or more and less than 1,080 MPa, EL ≥20%

TS of 1,080 MPa or more and less than 1,180 MPa, EL 16%

TS of 1,180 MPa or more and less than 1,270 MPa, EL 12% (sheet thickness: 1.2 mm or more and 1.8 mm or less)

The hole expandability was evaluated pursuant to JIS Z 2256 (2010). Each of the obtained steel sheets was cut into 100 mm×100 mm, then a hole with a diameter of 10 mm was punched with a clearance of 12%±1%, or a hole was shaved to be enlarged to a hole with a diameter of 10 mm by reaming, then while being pressed with a wrinkle pressing force of 9 tons using a die with an inner diameter of 75 mm, a 60° conical punch was pressed into the hole to measure a hole diameter at a crack occurrence limit, a limit hole expansion ratio λ (%) was determined from the following expression, and the hole expandability was evaluated from the value of this limit hole expansion ratio λ. The reaming refers to shaving and enlarging an inner diameter machined with a drill to a certain hole dimension with a cutting blade part and, in addition, finishing a machined face while grinding it down with a margin part.

Limit hole expansion ratio λ (%)$=\{(D_f-D_0)/D_0\}\times 100$

Where $D_f$ is a hole diameter (mm) at the time of occurrence of a crack, whereas $D_0$ is an initial hole diameter (mm). In the present invention, the following cases were determined to be favorable for each TS range.

TS of 980 MPa or more and less than 1,080 MPa, (punching)λ≥15%, (reaming)λ≥40%

TS of 1,080 MPa or more and less than 1,180 MPa, (punching)λ≥12%, (reaming)λ≥35%

TS of 1,180 MPa or more and less than 1,270 MPa, (punching)λ≥10%, (reaming)λ≥30%

The chemical conversion treatability was evaluated by forming a chemical conversion film by performing chemical conversion treatment by the following method using a chemical conversion treatment liquid (Palbond L3080 (registered trademark)) manufactured by Nihon Parkerizing Co., Ltd. on the obtained cold rolled steel sheet. Specifically, first, the obtained cold rolled steel sheet was degreased using a degreasing liquid Fine Cleaner (registered trademark) manufactured by Nihon Parkerizing Co., Ltd. and was then washed with water. Next, using a surface conditioner Prepalene Z (registered trademark) manufactured by Nihon Parkerizing Co., Ltd., surface conditioning with 30 seconds was performed. The cold rolled steel sheet subjected to the surface conditioning was immersed in a 43° C. chemical conversion treatment liquid (Palbond L3080) for 120 seconds, was then washed with water, and was dried with hot air. Thus, the cold rolled steel sheet was subjected to the chemical conversion treatment. For a surface of the cold rolled steel sheet after the chemical conversion treatment, five fields of view were randomly observed with a 500-fold magnification using a SEM. An area fraction [%] of areas with no chemical conversion film formed (voids) was determined by image processing, and the following evaluation was performed depending on the determined area fraction. With Mark 4 or Mark 5, the chemical conversion treatability can be said to be favorable. Among them, Mark 5 is preferred.

Mark 5: 5% or less

Mark 4: greater than 5% and 10% or less

Mark 3: greater than 10% and 25% or less

Mark 2: greater than 25% and 40% or less

Mark 1: greater than 40%

The coatablility was evaluated through appearance. A case in which appropriate surface quality was ensured without faulty appearance including uncoating, alloying unevenness, and other defects impairing surface quality was determined to be "good", a case having excellent appearance without any particular color tone unevenness or the like was determined to be "excellent", a case in which minor defects were partially found was determined to be "fair", and a case in which many surface defects were found was determined to be "poor".

As is clear from Table 3, in all the examples, high-strength steel sheets having a TS of 980 MPa or more and being excellent in formability were obtained. On the other hand, in the comparative examples, they were inferior in at least one characteristic of TS, EL, λ, the chemical conversion treatability, and the coatablility.

INDUSTRIAL APPLICABILITY

The present invention can provide a high-strength steel sheet having a tensile strength (TS) of 980 MPa or more and having excellent formability and a method for manufacturing the same.

The invention claimed is:

1. A high-strength steel sheet comprising:

a component composition including: by mass %, C: 0.030% to 0.250%; Si: 0.01% to 3.00%; Mn: 3.10% to 4.20%; P: 0.001% to 0.100%; S: 0.0001% to 0.0200%; N: 0.0005% to 0.0100%; Al: 0.001% to 1.200%; and balance Fe and inevitable impurities; and a steel structure with:

ferrite being 35% to 80%, martensite being 5% to 35%, and tempered martensite being 0.1% to 5% in terms of area fraction;

retained austenite being 8% or more in terms of volume fraction and 60% or less in terms of area fraction;

an average grain size of the ferrite being 6 μm or less;

an average grain size of the retained austenite being 3 μm or less;

a value obtained by dividing an area fraction of blocky austenite by a sum of area fractions of lath-like austenite and the blocky austenite being 0.6 or more;

a value obtained by dividing an average Mn content, by mass %, in the retained austenite by an average Mn content, by mass %, in the ferrite being 1.5 or more; and a value obtained by dividing an average C content, by mass %, in the retained austenite by an average C content, by mass %, in the ferrite being 3.0 or more, wherein the high-strength steel sheet has a tensile strength of 980 MPa or more.

2. The high-strength steel sheet according to claim 1, wherein the component composition of the high-strength steel sheet further includes: by mass %, at least one element selected from Ti: 0.005% to 0.200%; Nb: 0.005% to 0.200%; V: 0.005% to 0.500%; W: 0.005% to 0.500%; B: 0.0003% to 0.0050%; Ni: 0.005% to 1.000%, Cr: 0.005% to 1.000%, Mo: 0.005% to 1.000%, Cu: 0.005% to 1.000%, Sn: 0.002% to 0.200%, Sb: 0.002% to 0.200%, Ta: 0.001% to 0.100%, Ca: 0.0005% to 0.0050%, Mg: 0.0005% to 0.0050%, Zr: 0.0005% to 0.0050%, and REM: 0.0005% to 0.0050%.

3. The high-strength steel sheet according to claim 1, wherein the value obtained by dividing the average C content, by mass %, in the retained austenite by the average C content, by mass %, in the ferrite is 5.0 or more.

4. The high-strength steel sheet according to claim 1, wherein the value obtained by dividing the area fraction of blocky austenite by the sum of the area fractions of the lath-like austenite and the blocky austenite is 0.8 or more.

5. The high-strength steel sheet according to claim 1, wherein the volume fraction of the retained austenite in the steel structure is 8% or more and 24% or less in terms of volume fraction.

* * * * *